US011771289B2

(12) United States Patent
Blaz

(10) Patent No.: US 11,771,289 B2
(45) Date of Patent: Oct. 3, 2023

(54) HANDHELD SWEEPER WITH ROTATING BRISTLES FOR REMOVING HAIR AND FUR FROM SURFACES

(71) Applicant: Michael Blaz, Kihei, HI (US)

(72) Inventor: Michael Blaz, Kihei, HI (US)

( * ) Notice: Subject to any disclaimer, the term of this patent is extended or adjusted under 35 U.S.C. 154(b) by 0 days.

(21) Appl. No.: 17/497,933

(22) Filed: Oct. 9, 2021

(65) Prior Publication Data

US 2023/0114978 A1 Apr. 13, 2023

(51) Int. Cl.

| | |
|---|---|
| ***A47L 11/40*** | (2006.01) |
| ***A46B 13/00*** | (2006.01) |
| ***A46B 9/02*** | (2006.01) |
| ***A46B 13/02*** | (2006.01) |
| ***A46B 5/00*** | (2006.01) |
| ***A46D 1/00*** | (2006.01) |

(52) U.S. Cl.

CPC ..... *A47L 11/4041* (2013.01); *A46B 5/002* (2013.01); *A46B 9/026* (2013.01); *A46B 13/001* (2013.01); *A46B 13/02* (2013.01); *A46D 1/0207* (2013.01); *A47L 11/4005* (2013.01); *A47L 11/4025* (2013.01); *A47L 11/4069* (2013.01); *A47L 11/4075* (2013.01); *A46B 2200/3033* (2013.01)

(58) Field of Classification Search

CPC ..... A47L 11/24; A47L 11/32; A47L 11/33; A47L 11/4041; A47L 11/4069; A47L 11/4013; A47L 11/4025; A47L 11/4075; A46B 13/001; A46B 13/02; B25G 1/04; B25G 1/06

USPC ..... 15/23, 144.2, 144.3, 41.1, 48

See application file for complete search history.

(56) References Cited

U.S. PATENT DOCUMENTS

| | | | | |
|---|---|---|---|---|
| 4,042,995 | A * | 8/1977 | Varon | A46B 3/005 15/207.2 |
| 7,134,160 | B2 * | 11/2006 | Tawara | A47L 11/4013 15/98 |
| 7,140,060 | B1 * | 11/2006 | Walker | A47L 11/4069 15/98 |
| 7,152,267 | B2 * | 12/2006 | Kaleta | A47L 11/4041 15/52.1 |
| 7,340,795 | B2 * | 3/2008 | Kaleta | A47L 11/4069 15/52.1 |
| 7,591,039 | B2 * | 9/2009 | Kaleta | A47L 11/32 74/606 R |
| 7,861,351 | B2 * | 1/2011 | Ho | A47L 11/33 15/52.1 |
| 8,468,633 | B2 * | 6/2013 | Arnold | A47L 11/4036 15/4 |
| 2004/0181888 | A1 * | 9/2004 | Tawara | A47L 25/005 428/40.1 |

(Continued)

FOREIGN PATENT DOCUMENTS

| | | | | |
|---|---|---|---|---|
| CA | 2736331 | A1 * | 10/2011 | A47L 5/28 |
| FR | 2875726 | A1 * | 3/2006 | A47L 13/12 |

*Primary Examiner* — Orlando E Aviles
*Assistant Examiner* — Sharonda T Felton
(74) *Attorney, Agent, or Firm* — Steven Rinehart

(57) ABSTRACT

A cleaning implement which utilizes a low-power motor coupled to a plurality of angle gears and drive lines for creating a mechanical action adapted to clean hair and fur. The device includes a housing, which may be bifurcated, and a plurality of bristled protrusions positioned in staggered form along elongated shafts connected to drive lines using angle gears.

16 Claims, 6 Drawing Sheets

(56) References Cited

U.S. PATENT DOCUMENTS

| | | | | |
|---|---|---|---|---|
| 2005/0005377 | A1* | 1/2005 | Kaleta | A47L 11/4072 15/42 |
| 2005/0181968 | A1* | 8/2005 | Policicchio | A47L 13/20 510/438 |
| 2006/0242775 | A1* | 11/2006 | Ho | A47L 11/33 15/52.1 |
| 2006/0248680 | A1* | 11/2006 | Heidenga | A47L 9/04 15/387 |
| 2007/0074358 | A1* | 4/2007 | Tsai | A46B 5/0058 15/42 |
| 2009/0313784 | A1* | 12/2009 | Murdoch | A47L 9/325 15/410 |
| 2019/0246864 | A1* | 8/2019 | Ziamandanis | B25G 1/102 |
| 2019/0246867 | A1* | 8/2019 | Ziamandanis | B25G 1/04 |

* cited by examiner

HANDHELD SWEEPER WITH ROTATING BRISTLES FOR REMOVING HAIR AND FUR FROM SURFACES

BACKGROUND OF THE INVENTION

Field of the Invention

This invention relates to cleaning implements and more particularly relates to cleaning devices and more particularly relates to an implement with rotating bristles optimized to collect pet fur and hair.

Description of the Related Art

The Pet Industry is currently a $100+ billion dollar industry that is on the rise with the proliferation of diseases such as Covid and greater demand for pet ownership. With this increase in ownership, comes increased demand for pet grooming devices, including devices adapted to collecting pet hair and fur.

Pet hair is much harder to collect and remove than dust and traditional types of contaminants in a residential setting. Although vacuums intended to collect fur and hair have been introduced in the art, none work efficiently enough to have achieved large market share. These devices in the art do not have specific design characteristics required to be effective and to cover the many difficulties inherent to optimally clean (collect) hair and fur left behind by pets during the normal and systematic loss of hair by the animal. Pet owners are constantly battling pet hair on beds, sofas, car seats and other horizontal surfaces without a convenient, effective, and viable solution exclusively designed for maximum efficiency in the disposition of pet hair.

Pet owners go to great lengths to control the amount of pet hair that accumulates in their homes. Shed pet hair is generally unhygienic and may reflect poorly on a pet owner's cleanliness, while also causing allergic reactions to visitors.

Attempting to control pet shed with a handheld brush has limited effectiveness and is impractical when cleaning a large surface like a queen-sized bed.

There is a need in the art for a handheld sweeper with rotating bristles exclusively designed to remove pet hair from horizontal surfaces.

SUMMARY OF THE INVENTION

From the foregoing discussion, it should be apparent that a need exists for an implement for collecting loose hair and fur. Beneficially, such an apparatus would overcome many of the difficulties and safety concerns expressed, by providing a cost-effective, literally effective, means of cleaning hair and fur. An implement, therefore, is provided for collecting loose hair comprising: two or more roller assemblies, each roller assembly comprising an elongated shaft and a plurality of frustoconical bristle assemblies; a rearward roller assembly elongated to a length exceeding a length of the forward roller assemblies; a motor; a housing bifurcated into two or more interlocking components; an elongated handle affixed with a ball joint to a top surface of the housing; a plurality of drive lines affixed to the elongated shafts using right angle gears; a lower panel affixed to the lower housing component adapted to swing open to empty the contents of the implement.

The roller assemblies may be connected in parallel.

In some embodiments, the lower panel positions between the rearward roller assembly and the forward roller assemblies.

The bristle assemblies may position in staggered fashion across the elongated shaft. Alternatively or additionally, the bristles may be positioned forming a double-helix pattern about the elongated shaft.

The bristles may be formed of polymeric components. The apparatus may further comprise a power supply. The elongated handle may be bifurcated into two interlocking components.

In some embodiments, the implement further comprising a subassembly switch.

A second implement for collecting loose hair comprising is provided: two or more roller assemblies, each roller assembly comprising an elongated shaft and a plurality of bristles; a rearward roller assembly elongated to a length exceeding a length of the forward roller assemblies; a motor; a housing; an elongated handle; a plurality of drive lines affixed to the elongated shafts using right angle gears; a lower panel affixed to the lower housing component adapted to swing open to empty the contents of the implement.

The roller assemblies may be connected in parallel. The lower panel may position between the rearward roller assembly and the forward roller assemblies.

The bristle assemblies may position in staggered fashion across the elongated shaft. The bristles may position forming a double-helix pattern about the elongated shaft.

In some embodiments, the bristles are formed of polymeric components. The implement may further comprise a power supply. The elongated handle may be bifurcated into two interlocking components. The implement may further comprise a subassembly switch.

The present invention has been developed in response to the problems and needs in the art that have not yet been fully solved by currently available devices and methods. Accordingly, the present invention has been developed to provide an implement for collecting loose hair comprising: two or more roller assemblies, each roller assembly comprising an elongated shaft and a plurality of frustoconical bristle assemblies; a motor; a housing; and a plurality of drive lines affixed to the elongated shafts using angle gears.

The roller assemblies may be connected in parallel.

The bristle assemblies may be positioned in staggered fashion across the elongated shaft. In other embodiments, the housing is bifurcated into a plurality of interlocking members.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

FIGS. 1-7 illustrate various embodiments of the handheld implement 100-700. These embodiments comprise two or more roller assemblies, each comprising a plurality of bristles 202, which may be conical or frustoconical.

Figure 1:
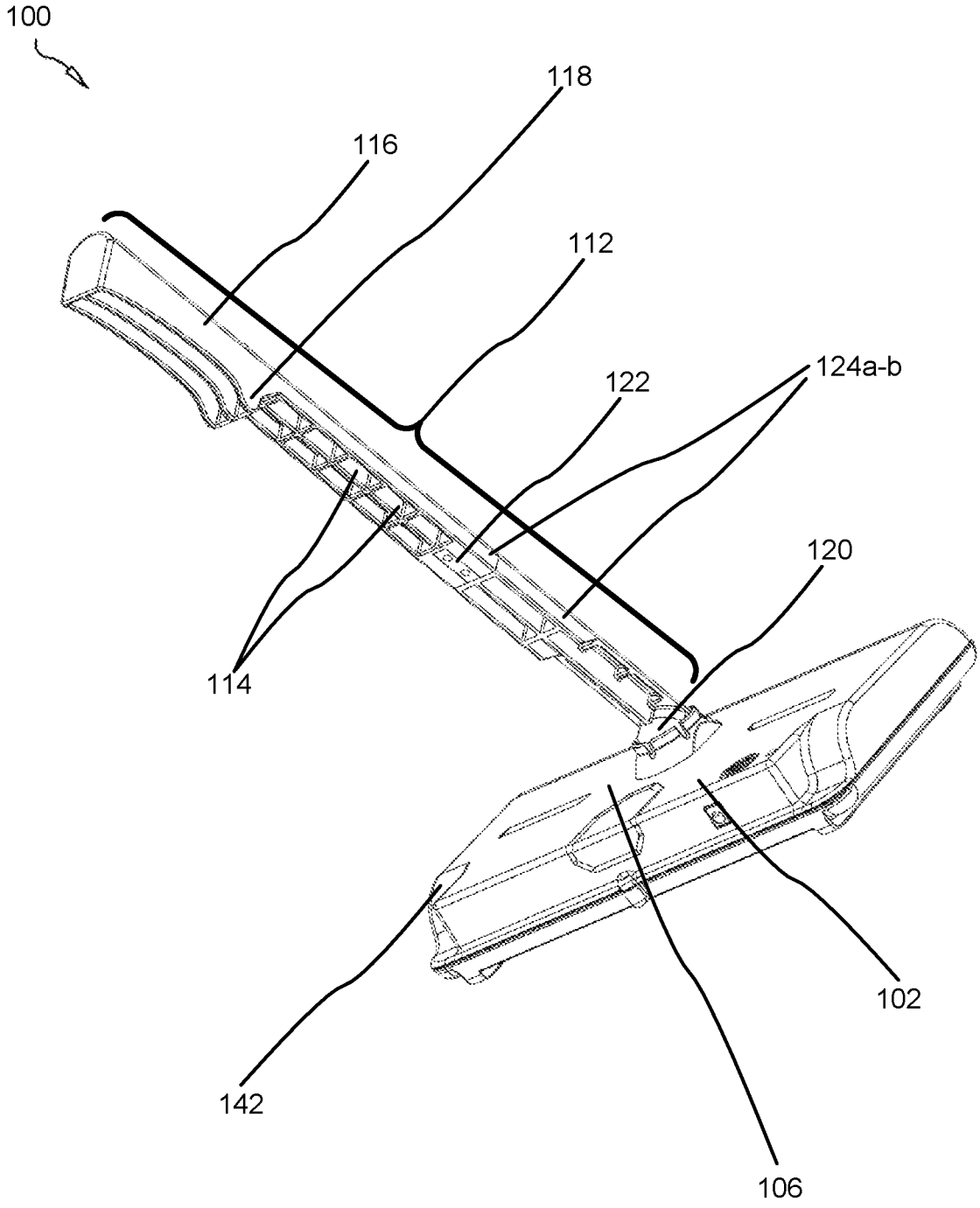
FIG. 1 is an isometric, rearward side perspective view of an implement for collecting loose hair and fur in accordance with the present invention.

FIG. 1 is an isometric, rearward side perspective view of an implement 100 for collecting loose hair and fur in accordance with the present invention.

In various embodiments, the implement 100 is battery operated and/or comprises a power supply, such as a lithium-ion battery (indicated at 8). The implements 100-700 may additionally or alternatively comprise a A/C and/or D/C electric plug.

In various embodiments, the implement 100 comprises an elongated handle 112, which may be cylindrical, tubular, or shaft-like. In various embodiments, the handle 112 comprises an inner lattice structure 114. The handle 112 may comprise two elongated shafts 124*a-b* which join together using one or more screws at a junction point 122.

The proximal end of the handle 112 may join with the housing 102 as shown. In various embodiments, the handle 112 comprises a distal end 116 contoured for engagement by one or more hands. The handle 112 may be ergonomically contoured for comfort and utility as shown with one or more downwardly-protruding protuberances 118.

The handle 112 may comprise a ball joint 120, a semi-spherical proximal end adapted to rotate about multiple axes within a socket 322 affixed to the housing 102, 312. The socket 322 may define a hollow interior recess adapted to receive the ball joint 120.

The housing may comprise corners 142 which are recessed below a top surface of the housing 102. The corners may comprise planar top surfaces and arcuate inclined ramps merging with the top surface of the housing.

Figure 2:
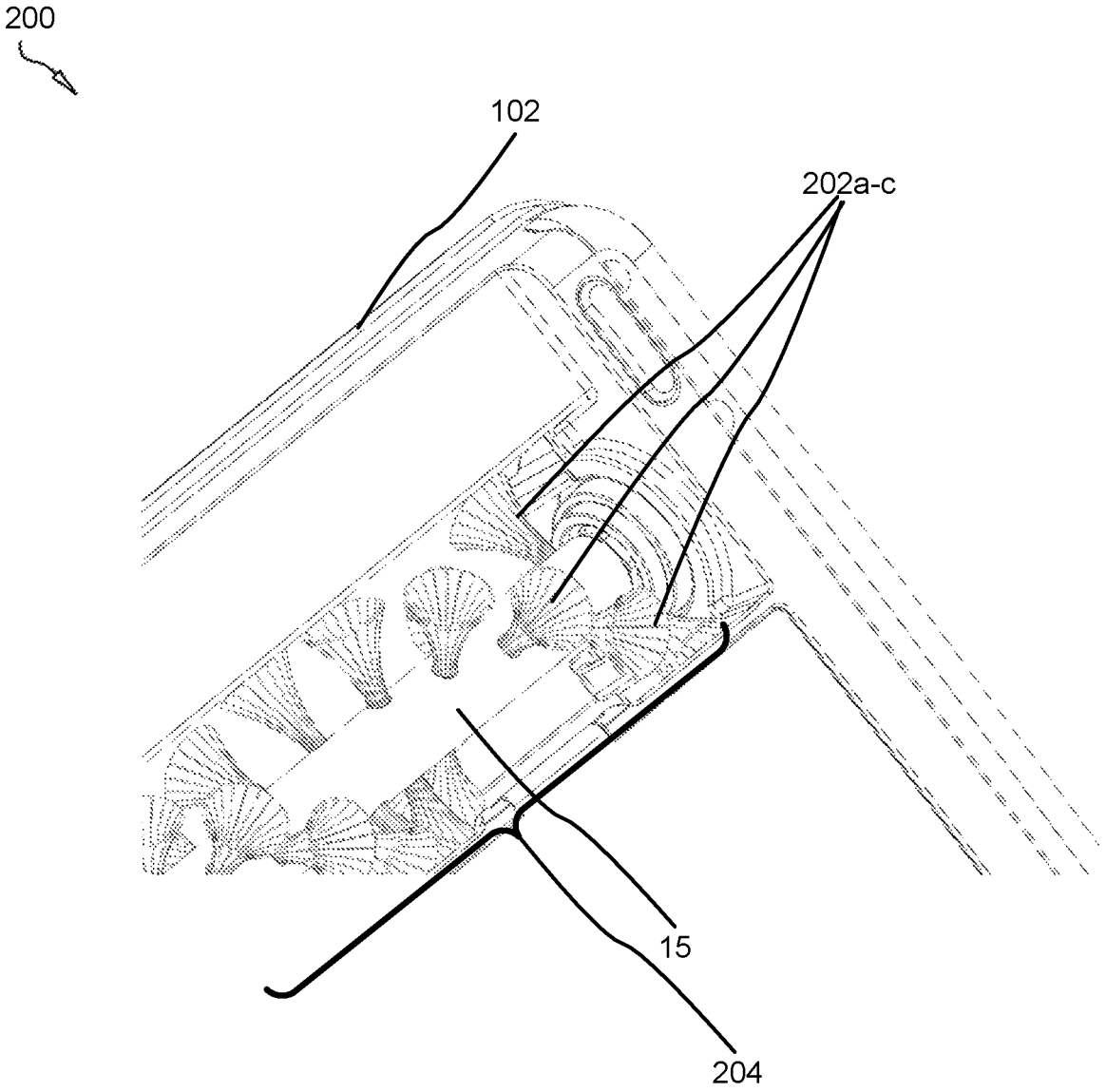
FIG. 2 is a lower perspective view of an implement for collecting loose hair and fur in accordance with the present invention.

FIG. 2 is a lower perspective view of an implement 200 for collecting loose hair and fur in accordance with the present invention.

The implement 200 comprises a roller assembly 204 comprising an elongated shaft 15 having a plurality of bristles 202*a-c* which circumscribe the exterior surface of the elongated shaft 15 at regularly- or irregularly-spaced intervals.

Figure 3:
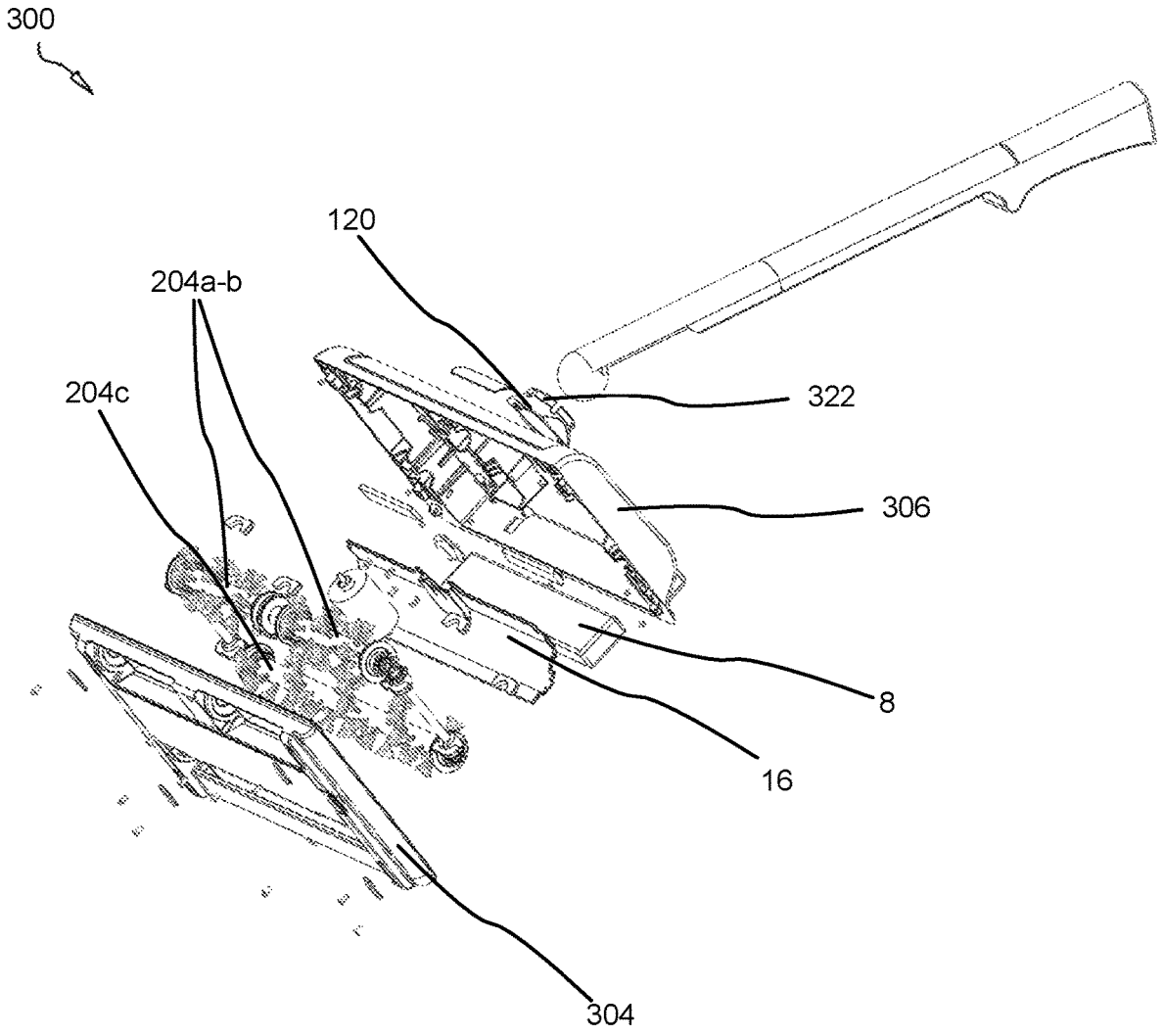
FIG. 3 is an exploded perspective view of an implement for collecting loose hair and fur in accordance with the present invention.

The bristles 202 may comprise cylindrical, conical or frustoconical protuberances which may be smaller in circumference at a junction point with the elongated shaft 15 than at distal ends in which they flare outwardly and radially. The bristles 202 may be formed from rigid, flexible, or semi-flexible polymeric materials FIG. 3 is an exploded perspective view of an implement for collecting loose hair and fur 300 in accordance with the present invention.

In various embodiments, the housing 102 is bifurcated into two or more interlocking components, including an upper housing component 306 and a lower housing component 304. These components interlock forming a hollow interior recess in which the roller assemblies 204, battery, and other components are housed.

In various embodiments, the apparatus 300 comprises three roller assemblies 204*a-c*, including two forward roller assemblies 204*a-b* and a rearward assembly 204*c*. The rearward roller assembly 204*c* is more elongated than the forward assemblies 204*a-b*. The roller assemblies 204*a-c* are connecting using angle gears, including a right angle gear 9, to one another such that all the roller assemblies rotate together when driven by the motor. The two forward roller assemblies may be counterrotating.

Figure 4:
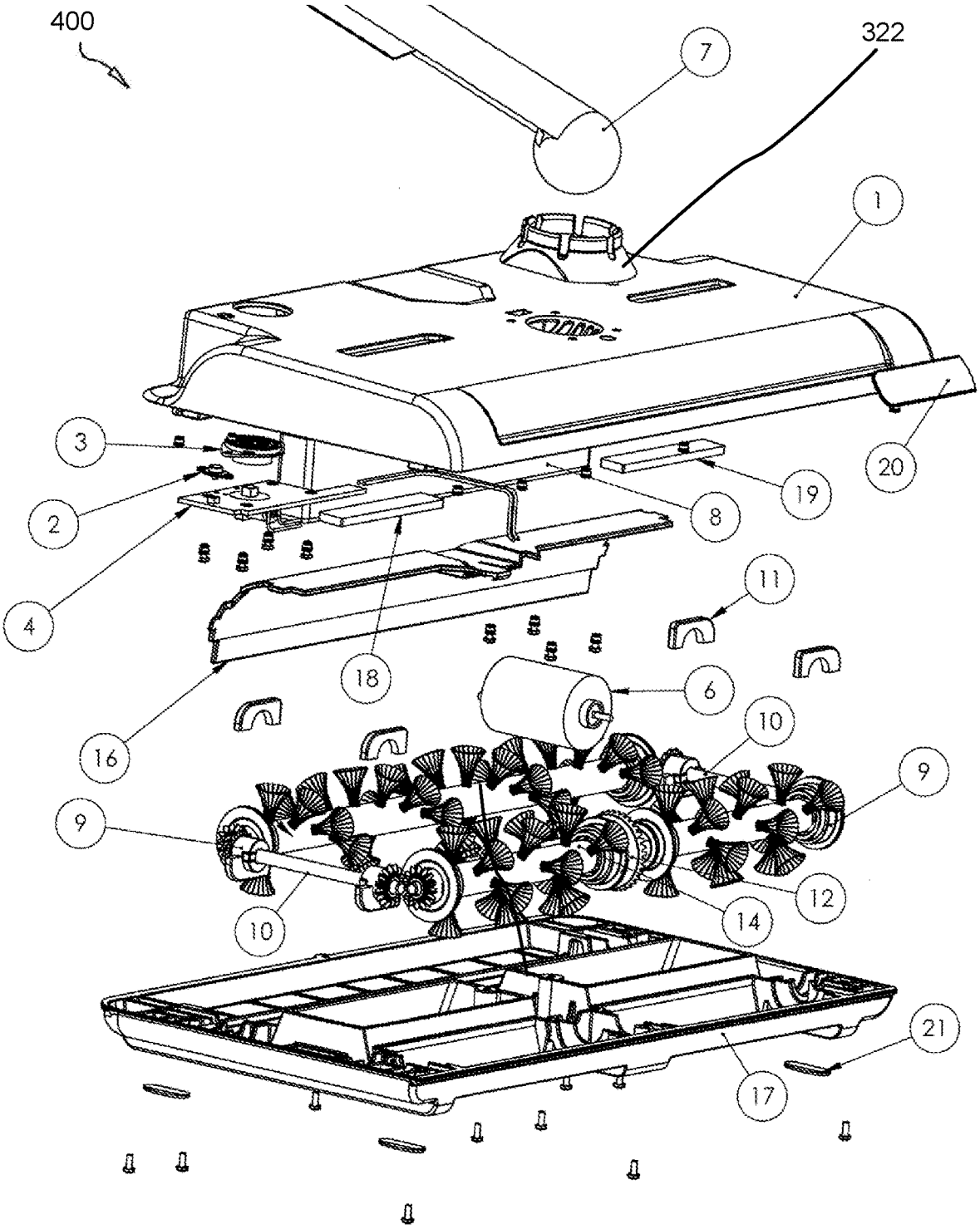
FIG. 4 is an exploded perspective view of an implement for collecting loose hair and fur in accordance with the present invention.

FIG. 4 is an exploded perspective view of an implement for collecting loose hair and fur 400 in accordance with the present invention.

The upper housing is indicated at 106 and 1. The light pipe is indicated at 2. The sub assembly button is indicated at 3 and the PCB assembly is indicated at 4. The socket collar is indicated at 4 and the electric motor is indicated 6. The sub assembly handle is indicated at 7 and the power supply/battery is indicated at 8. The right angle gear is indicated at 9 and the drive line is indicated at 10. The wear pad is indicated at 11 and the differential is indicated at 12. The left roller assembly is indicated at 14. The electronics cover is indicated at 16 and the lower sub assembly housing is indicated at 17. The dummy panel is indicated at 18 and the exhaust filter is indicated 19. The name plate is indicated at 20 and the skid pad is indicated at 21.

The motor 6 may be positioned such that its drive shaft spins perpendicularly to the roller assemblies and above the lower panel 702. In some embodiments, the apparatus 400 comprises four or more right angle gears. In some embodiments, the battery 8 is disposed aft of the lower panel 702 and ball joint 120 for balance. The handle may be between six inches and six feet long.

Figure 5:
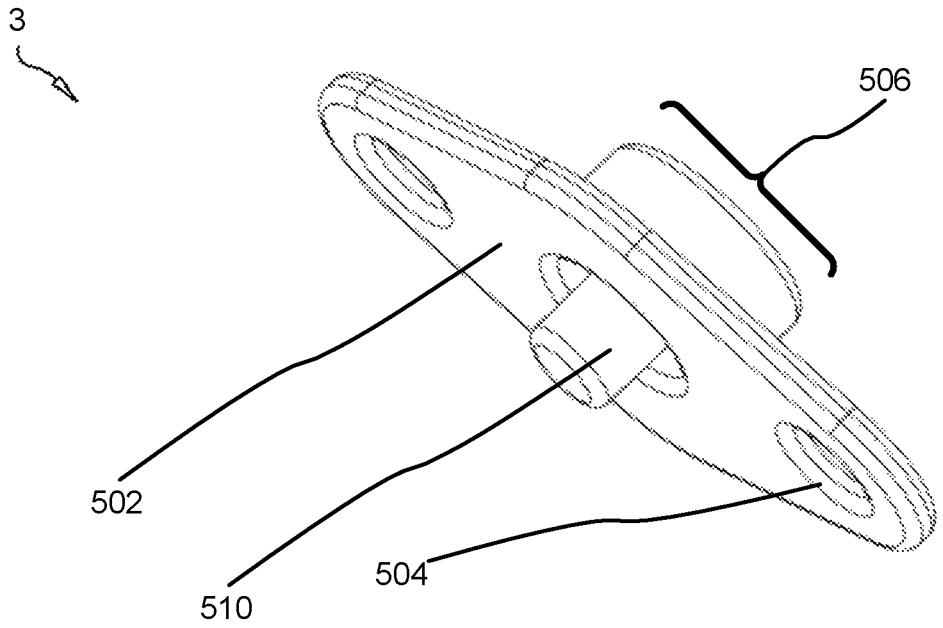
FIG. 5 is a side perspective view of a subassembly button 3 of an implement for collecting loose hair and fur in accordance with the present invention.

FIG. 5 is a side perspective view of a subassembly button 3 of an implement 400 for collecting loose hair and fur in accordance with the present invention.

The subassembly 3 comprises a depressible button 510, a bracket 502 defining a plurality of bores 504, and a rearwardly-protruding switch housing 506 cylindrical in shape in some embodiments.

Figure 6:
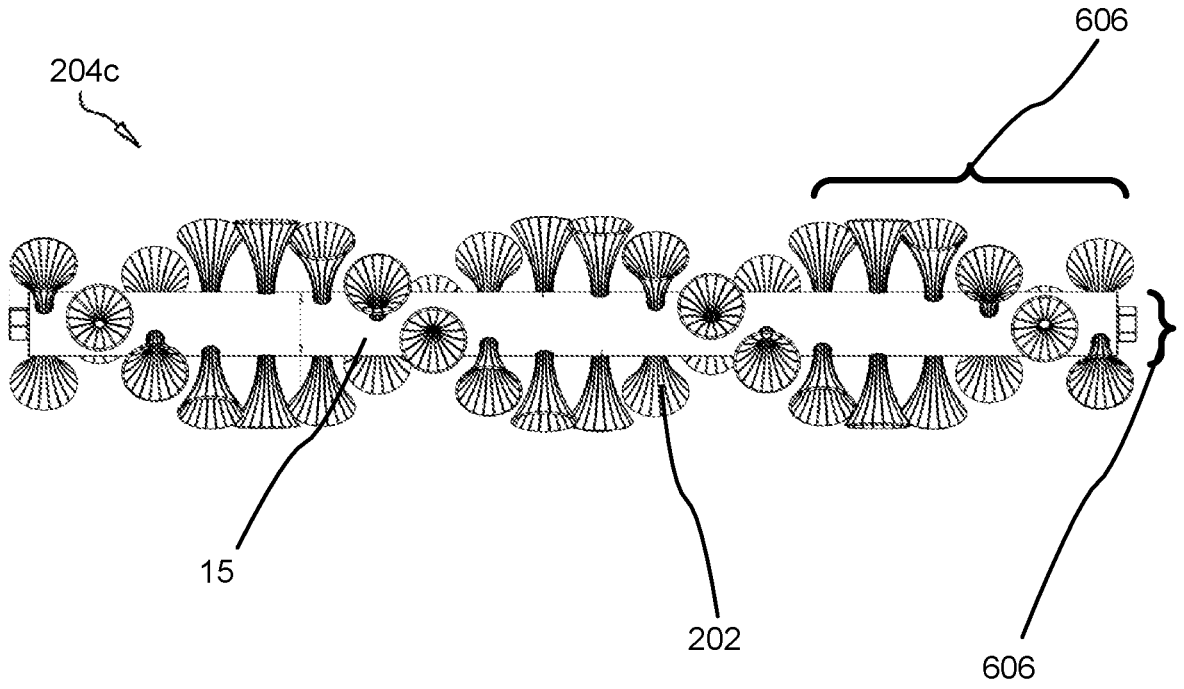
FIG. 6 is a side perspective view of a rearward roller assembly 204*c* of an implement 400 adapted for collection of loose hair and fur in accordance with the present invention.

FIG. 6 is a side perspective view of a rearward roller assembly 204*c* of an implement 400 adapted for collection of loose hair and fur in accordance with the present invention.

In various embodiments, the bristles 202 are arranged so as to form a double-helix orientation across the exterior surface of the elongated shaft 15. The elongated shaft 15 may comprise laterally-protruding gears 606 at distal and proximal ends which join with a right angle gear 9.

Figure 7:
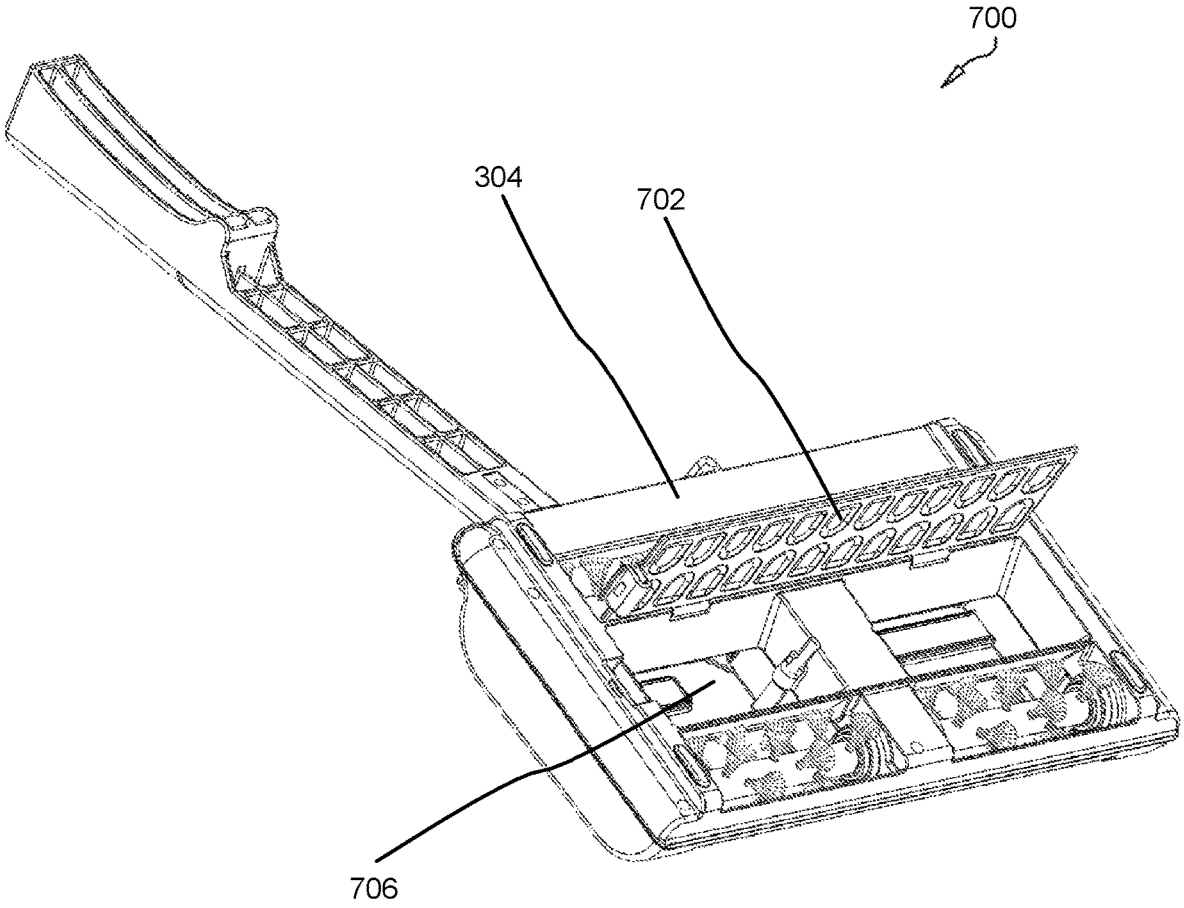
FIG. 7 is a lower perspective view of an implement for collecting loose hair and fur in accordance with the present invention.

FIG. 7 is a lower perspective view of an implement for collecting loose hair and fur in 700 accordance with the present invention.

In various embodiments, a lower panel 702 is hingedly affixed to the lower housing component 304. This lower panel 702 swings open to empty the contents of the apparatus 100. The lower panel 702 may be disposed between the roller assemblies 204 and the ball joint 120. In various embodiments, the lower panel 702 is aft of the roller assemblies 204*a-c*.

In still further embodiments, the lower panel 702 positions between the rearward roller assembly 204*c* and the forward roller assemblies 204*a-b*, and positions between drive lines 10 as shown.

In various embodiments, the apparatus 700 comprises a lower panel 702 defining a hollow interior recess for housing the motor 6, the hollow interior recess may bifurcate the recess above the panel 702 such that each forward roller assembly 204*a-b* is forwardly disposed before a bifurcated compartment 706.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An implement for collecting loose hair comprising:

two forward roller assemblies, each roller assembly comprising an elongated shaft and a plurality of frustoconical bristle assemblies;

wherein the two roller assemblies are counterrotating;

a rearward roller assembly elongated to a length exceeding a length of the forward roller assemblies; four or more right angle gears; wherein the two or more forward roller assemblies and the rearward roller assembly are connected using a right angle gear of the four or more right angle gears;

a motor positioned such that a drive shaft of the motor spins perpendicularly to the two forward roller assemblies and the rearward roller assembly, wherein the motor is positioned above a lower panel;

a housing bifurcated into two or more interlocking components;

an elongated handle affixed with a ball joint to a top surface of the housing, the elongated handle comprising an inner lattice structure;

a plurality of drive lines affixed to the elongated shafts using the four or more right angle gears;

the lower panel affixed to the lower housing component adapted to swing open to empty the contents of the implement, wherein the lower panel is positioned between the rearward roller assembly and the two forward roller assemblies.

2. The implement of claim 1, wherein the lower panel is hingedly affixed.

3. The implement of claim 1, wherein the lower panel is positioned between the rearward roller assembly and the forward roller assemblies.

4. The implement of claim 1, wherein the bristle assemblies are positioned in staggered fashion across the elongated shaft.

5. The implement of claim 1, wherein the bristles are positioned forming a double-helix pattern about the elongated shaft.

6. The implement of claim 1, wherein the bristles are formed of polymeric components.

7. The implement of claim 1, further comprising a power supply.

8. The implement of claim 1, wherein the elongated handle is bifurcated into two interlocking components.

9. The implement of claim 1, further comprising a subassembly switch.

10. An implement for collecting loose hair comprising:

two forward roller assemblies, each roller assembly comprising an elongated shaft and a plurality of bristles;

wherein the two roller assemblies are counterrotating;

a rearward roller assembly elongated to a length exceeding a length of the forward roller assemblies; four or more right angle gears; wherein the two or more forward roller assemblies and the rearward roller assembly are connected using a right angle gear of the four or more right angle gears;

a motor positioned such that a drive shaft of the motor spins perpendicularly to the two forward roller assemblies and the rearward roller assembly, wherein the motor is positioned above a lower panel;

a housing;

an elongated handle;

a plurality of drive lines affixed to the elongated shafts using right angle gears of the four or more right angle gears;

a lower panel affixed to the lower housing component adapted to swing open to empty the contents of the implement, wherein the lower panel is positioned between the rearward roller assembly and the two forward roller assemblies.

11. The implement of claim 10, wherein the lower panel is positioned between the rearward roller assembly and the forward roller assemblies.

12. The implement of claim 10, wherein the bristle assemblies are positioned in staggered fashion across the elongated shaft.

13. The implement of claim 10, wherein the bristles are positioned forming a double-helix pattern about the elongated shaft.

14. The implement of claim 10, wherein the bristles are formed of polymeric components.

15. The implement of claim 10, further comprising a power supply.

16. The implement of claim 10, wherein the elongated handle is bifurcated into two interlocking components.

* * * * *